United States Patent [19]

Brown

[11] 4,259,041

[45] Mar. 31, 1981

[54] HIGH FLOW STANDING VALVE

[75] Inventor: F. Barton Brown, La Crescenta, Calif.

[73] Assignee: Kobe, Inc., Commerce, Calif.

[21] Appl. No.: 50,720

[22] Filed: Jun. 21, 1979

[51] Int. Cl.[3] ..... F04B 21/06; F04B 39/10

[52] U.S. Cl. ..... 417/559; 137/512; 137/1; 417/545

[58] Field of Search ..... 417/503, 545, 546, 547, 417/548, 549, 550, 551, 552, 553, 554, 451, 453, 559–571; 137/512, 512.1

[56] References Cited

U.S. PATENT DOCUMENTS

| | | | |
|---|---|---|---|
| 961,820 | 6/1910 | Waitt | 417/503 |
| 1,669,130 | 5/1928 | Jenson | 417/547 |
| 1,809,814 | 6/1931 | Schutt | 417/549 |
| 2,812,721 | 11/1957 | Coberly | 417/503 |
| 2,902,049 | 9/1959 | Ilfrey | 137/512.1 |
| 2,999,464 | 9/1961 | Coberly | 417/358 |
| 3,078,804 | 2/1963 | McArthur | 417/571 |
| 3,174,437 | 3/1965 | Street | 417/554 |

*Primary Examiner*—William L. Freeh

*Attorney, Agent, or Firm*—William C. Norvell, Jr.

[57] ABSTRACT

The invention provides a high flow rate standing valve for oil wells of the type employing a plurality of check valve units disposed in parallel between inlet and outlet passages, the flow area of the inlet or outlet passage each being not in excess of the total flow areas of the individual check valves so that no significant pressure drop is produced by fluid flow through the check valves in their open position. Specifically, the invention provides an improved configuration for such standing valves permitting the convenient manufacture and assembly of the valve components. In a modification of the invention, the standing valve housing is constructed so that its lower end is mounted on and co-operates with a conventional well safety valve.

10 Claims, 3 Drawing Figures

HIGH FLOW STANDING VALVE

BACKGROUND OF THE INVENTION

1. Field of the Invention:

The invention relates to standing valves of the type employed in the bottom of a submersible pumping apparatus for an oil well which prevents reverse fluid flow from the production casing back into the well whenever the pumping operation is interrupted or the pumping apparatus is removed from the well for servicing.

2. Description of the Prior Art:

This invention constitutes an improvement over the standing valve construction disclosed and claimed in co-pending application Ser. No. 50,921, filed June 21, 1979, entitled "High Flow Check Valve Apparatus" assigned to the same assignee as this application. Such co-pending application discloses a standing valve for oil wells wherein a plurality of check valve units are provided between two laterally spaced, parallel inlet and outlet passages. While the construction disclosed in said aforementioned co-pending application is completely functional to minimize the pressure drop involved in a standing valve when the check valves are in their open or flowing position, the disclosed construction required relatively complicated components which would only be produced by castings and complex machining operations. To reduce the manufacturing cost of this type of standing valve apparatus, and to simplify the assembly and servicing of the valve, it is desirable that the great majority of components of the standing valve be capable of being produced by simple machining operations. For example, it is desirable that all of the major fluid flow passages in the standing valve be defined by drilled holes in the main housing element, rather than by cast apertures.

Additionally, it is desirable that the standing valve be capable of being mounted directly adjacent to a tubing controlled sub-surface safety valve, which is now being required for installation in many wells, particularly oil wells drilled in the ocean floor.

SUMMARY OF THE INVENTION

This invention provides an improved construction of a standing valve for an oil well wherein the main housing element of the valve comprises a generally cylindrical housing and all of the plurality of check valve units of the valve are mounted in vertically stacked relationship within one of three longitudinally extending bores machined in such housing. The other two bores respectively define a fluid flow inlet passage and a fluid flow outlet passage of the check valve units of the standing valve.

In accordance with a modification of the invention, the lower end of the standing valve is constructed in such manner to be mounted immediately adjacent to a tubing controlled, subsurface safety valve to place the safety valve in an open condition whenever the standing valve is installed thereon, or may be installed in a casing installation where all of the production from the well passes through an extension which communicates with the production tubing.

Other objects and advantages of this invention will be apparent to those skilled in the art from the following detailed description.

DESCRIPTION OF THE PREFERRED EMBODIMENTS

Figure 1:
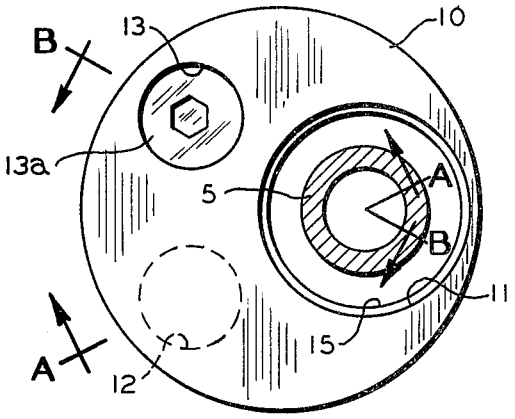
FIG. 1 comprises an end elevational view of a standing valve housing constructed in accordance with this invention.
Figure 3:
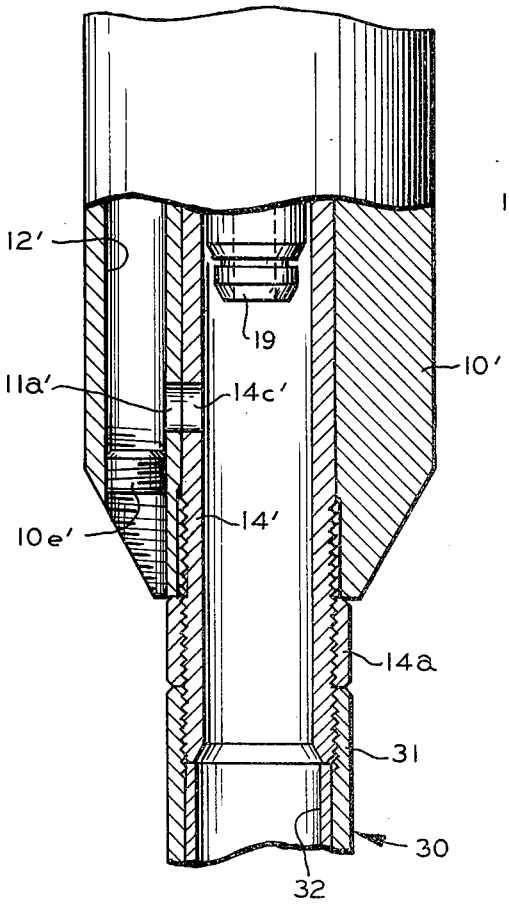
FIG. 3 is a view similar to FIG. 2, but showing a modification of this invention.
Figure 2:
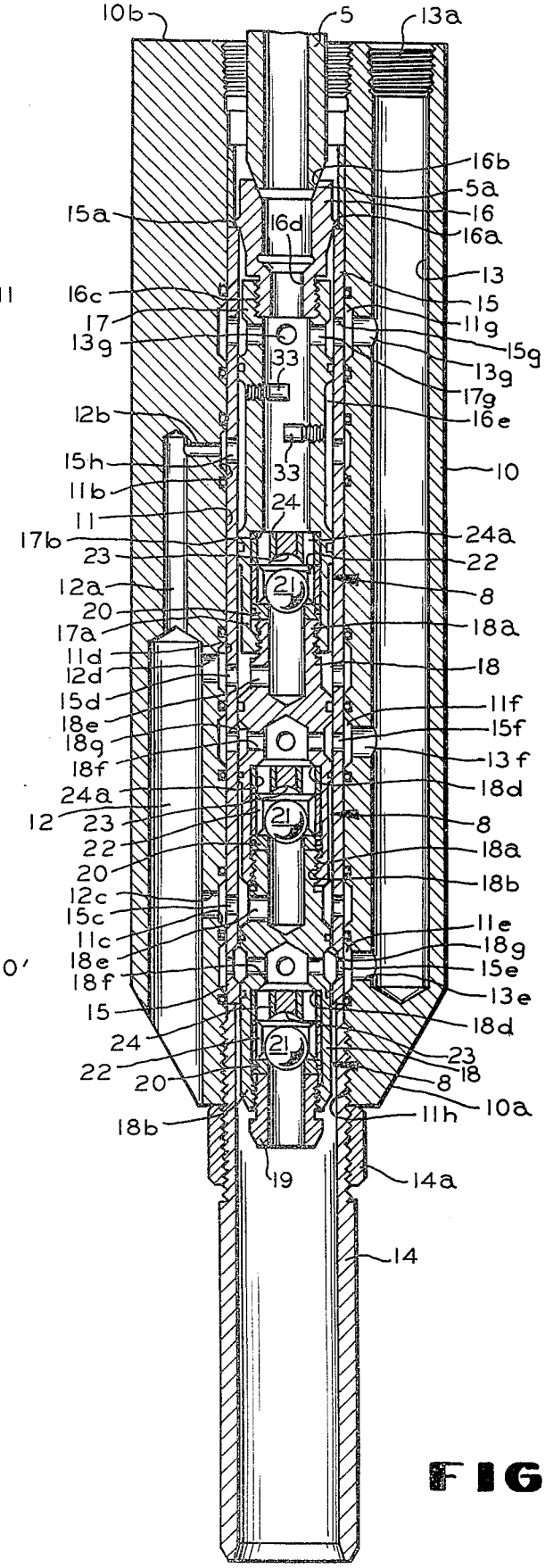
FIG. 2 constitutes a composite multi-plane sectional view taken on the planes A—A and B—B of FIG. 1.

Referring to the drawings, it should be first explained that the scale of all figures of the drawing is the same, but the sectional views of FIGS. 2 and 3 are larger than the elevational end view of FIG. 1 due to the fact that these figures constitute a composite of two sectional views taken on two different planes.

A standing valve constructed in accordance with this invention comprises a cylindrically shaped housing 10 having a tapered bottom end portion 10*a* and a flat top end portion 10*b*. Three longitudinally extending bores are provided in housing 10, preferably by a drilling operation, comprising a large diameter primary bore 11, a smaller diameter inlet bore 12 and an outlet bore 13. These three bores are preferably disposed in generally triangular relationship in a horizontal plane in order to permit the diameter of the housing 10 to be maintained small enough to be readily insertable within the casing of an oil well.

Inlet bore 12 extends upwardly from the tapered bottom surface 10*a* partially through the length of housing 10, terminating in a reduced diameter end passage 12*a* which communicates with a radial port 12*b* which in turn communicates with an annular recess 11*b* provided in the wall of primary bore 11 for the purpose to be hereinafter described. Additional radial ports 12*c* and 12*d* communicate respectively between inlet bore 12 and annular recesses 11*c* and 11*d* in the wall of primary bore 11.

The outlet bore 13 extends from the top surface 10*b* of housing 10 downwardly through substantially the entire length of housing 10 but terminates short of the bottom of housing 10. The top end of outlet bore 13 is closed by a threaded plug 13*a*. The outlet bore 13 is provided with a plurality of vertically spaced, radial ports 13*e*, 13*f* and 13*g* communicating respectively with annular recesses 11*e*, 11*f*, and 11*g* provided in the walls of the primary bore 11 for purposes to be hereinafter described.

The bottom end of primary bore 11 is provided with threads 11*h* which receive the threaded end of a tubular extension 14 which extends into the production zone of the well casing to receive the incoming well fluid. A locking sleeve 14*a* effects the securement of extension 14 to the housing 10.

A valve unit mounting sleeve 15 is inserted within the primary bore 11 and rests upon the top end of the extension sleeve 14. The sleeve 15 extends almost to the top of the bore 11. Just below its top portion, the sleeve 15 defines an upwardly facing shoulder 15*a* which provides a vertical support and seal for a flange 16*a* provided on an annular support bushing 16. The top surface of the support bushing 16 is provided with an upward taper 16*b* which effects a sealed engagement with the correspondingly tapered end 5*a* of a pump inlet casing 5. The support bushing 16 has a threaded annular bottom portion 16*c* to which is threadably secured to a tubular spacer member 17. Spacer member 17 has an internally threaded bottom portion 17*a* to which is threadably secured the first of a series of axially stacked check valve units 8 comprising threadably connected, identical valve chamber housings 18 each of which is successively threaded to an adjacent housing by threaded end portions 18*a* and 18*b*. The lowermost valve housing 18 has a threaded bushing 19 secured to its lower threaded end portion 18*b*.

The other components of each check valve 8, such as the valve seat 20, a check valve member 21, in this case illustrated as being a ball, a ball guiding cage 22, and a ball holding magnet 23 are identically mounted in each of the valve chambers respectively defined by the housings 18 and hence only one of such check valve units will be described.

Each check valve unit 8 comprises an annular valve seat 20 which is supported by the top end 18*a* of the next adjacent valve chamber housing 18 (or by a bushing 19 for the bottom unit). The check valve member 21 normally rests on seat 20 and thereby prevents fluid flow downwardly through the valve chamber housing 18. When the upward fluid pressure on the ball valve member 21 is sufficient to lift it off its seat, it is guided in its upward movements by the articulated annular cage 22 mounted above the seat 20 until the ball contacts the restraining magnet 23 which is suitably mounted on a spider-shaped support 24 extending across the valve chamber and held between the cage 22 and an internal shoulder 18*d* on housing 18 (or shoulder 17*b* in the case of the top unit). The provision of magnet 23 effectively prevents chattering of the ball valve and insures that it will positively move between its open and closed positions when sufficient pressure differentials exist.

Employment of a ball as the check valve member is only illustrative and a poppet type valve could be substituted therefor.

The fluid flow through each of the valve chambers is therefore limited by the annular area that exists between the ball valve 21 and its annular cage 22 when the ball valve is in its open position. In accordance with this invention, the effective flow area of the inlet fluid bore 12 and the outlet fluid bore 13 is not in excess of the sum of the individual fluid flow areas of the various check valves 8 which interconnect such inlet and outlet bores. Thus, to achieve any desired pumping volume, it is only necessary to provide a sufficient number of check valve units 8 disposed in parallel between the inlet bore 12 and the outlet bore 13 to provide sufficient flow area to reduce the fluid pressure drop across such valves to a minimum.

The fluid connections of the inlet bore 12 and the outlet bore 13 will now be described. In the modification of FIG. 2, the bottom end of inlet bore 12 is exposed to fluids entering the well casing which are drawn upwardly into the valving apparatus by the suction action exerted by the pump (not shown).

The radial ports 12*c* and 12*d* respectively permit the fluid to flow from the inlet bore 12 into the primary bore annular recesses 11*c* and 11*d* respectively, thence through a plurality of ports 15*c* and 15*d* in mounting sleeve 15, thence into the adjacent valve chamber of a check valve unit 8 through a series of radial ports 18*e* provided in the wall of the valve chamber housing 18. Immediately above the magnet supporting spider 24, the valve chamber housing 18 is provided with a plurality of spaced radial ports 18*f* which communicate with an annular recess 18*g*, thence through ports 15*e* and 15*f* of the mounting sleeve 15 respectively which communicate with the annular recesses 11*e* and 11*f* provided in the wall of the primary bore 11, and thence through radial ports 13*e* and 13*f* respectively to the outlet bore 13.

The fluid flowing up through outlet bore 13 passes through the radial port 13*g* at the top end of bore 13 into the annular recess 11*g* in the primary bore 11, through a plurality of ports 15*g* in the mounting sleeve 15, and then through radial ports 17*g* provided in the spacer sleeve 17 to the interior bore 16*d* of the support bushing 16 and then into the pump inlet 5.

In accordance with this invention, the fluid flow through the check valve units at the top and bottom of the stack of units 8 may be simplified. For example, the bottom check valve unit 8 has a direct fluid inlet to its chamber from the bore of the extension 14 and then discharges as described above through ports 18*f* in the valve chamber housing 18, the annular recess 18*g*, a plurality of ports 15*e* in mounting sleeve 15, annular recess 11*e* and a radial port 13*e* communicating with the outlet bore 13. At the top of the stack of check valve units 8, the inlet to the top check valve unit 8 from inlet bore 12 is the same as previously described; however, the outlet passage is provided by a direct connection of openings 24*a* in the magnet support spider 24 with the bore of the spacer member 17.

Referring now to FIG. 3 there is shown a modified end configuration of the standing valve apparatus of FIGS. 1 and 2 to permit the standing valve to be mounted directly upon a tubing controlled sub-surface safety valve unit 30 which is customarily provided with an upstanding annular nipple 31 within which a slidable actuator sleeve 32 is mounted. Such safety valves are well known and are commercially available from a number of sources. Typical of such safety valves are those as disclosed in: U.S. Pat. No. 3,797,573, issued Mar. 19, 1974, entitled "Full Opening Safety Valve", Talmadge L. Crowe, Inventor; U.S. Pat. No. 3,896,876, issued July 29, 1975, entitled "Subsurface Tubing Safety Valve with Auxiliary Operating Means", Talmadge L. Crowe, Inventor; and U.S. Pat. No. 3,868,995, issued Mar. 4, 1975, entitled "Sub-Surface Safety Valve", Talmadge L. Crowe, Inventor. In this configuration, the housing 10' is elongated to extend below the axial inlet of the lowermost check valve unit 8. Instead of the axial inlet bore 12' extending downwardly through the tapered lower surface of housing 10', it is provided with a plug 10*e'*. Fluid communication is then provided to the inlet bore 12' by a radial port 11*a'* formed in the wall of the primary bore 11 and port 14*c'* provided in extension 14'. The bottom end of extension 14' is threaded within the nipple 31 when mounting the standing valve unit on the safety valve 30 and depresses the actuator 32 to shift the safety valve to its open position.

It occasionally becomes necessary to remove a standing valve from a well for servicing, or to remove any accumulation of sand from the valve components. This may be accomplished in conventional fashion through the provision of knock-out plugs 33 which are threaded into the walls of the spacer sleeve 17 and lie inwardly thereof in a position to be engaged by a wire line tool and knocked loose, thus providing radial openings to permit the fluid contained in the interconnected production tubing and pump above the standing valve to drain through such openings into an annular space 16*e* provided between the spacer sleeve 16 and the interior wall of the mounting sleeve 15. A plurality of radial ports 15*h* in mounting sleeve 15 provide communication with the annular recess 11*b* provided in primary bore 11 and such recess is connected by radial port 12*b* to the end passage 12*a* of the inlet bore 12 to drain into the well casing.

Conventional seals, such as O-rings, are provided wherever required to prevent fluid leakage from the described paths through the standing valve apparatus, and such seals will not be described in detail.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A standing valve assembly for an oil well comprising: a cylindrical housing insertable on production tubing insertable within said well, said housing having a primary bore extending vertically therethrough; means for connecting the top end of said primary bore to a pump inlet; an inlet bore extending vertically from the bottom portion of said housing partially up through said housing; an outlet bore extending vertically downwardly from the top portion of said housing partially through said housing, said three bores being disposed in triangular relationship in cross-section and with the top portion of said inlet bore lying adjacent to the lower portion of said outlet bore; means for connecting the lower end of said primary bore to a source of well fluid; means in said housing connecting the lower end of said inlet bore to said source of well fluid; conduit means in said housing for connecting the upper portion of said outlet bore with said primary bore; means in said primary bore defining a plurality of axially stacked valve chambers intermediate said inlet bore and said outlet bore, each valve chamber having a generally horizontal inlet connecting with said fluid inlet bore, a generally horizontal outlet connecting with said fluid outlet bore and a valve seat between said inlet and said outlet; a check valve member cooperating with each of said valve seats to prevent reverse fluid flow from said outlet to said inlet, said inlet bore and said outlet bore having a flow area not in excess of the total flow areas of the valve chambers.

2. The standing valve of claim 1 wherein means are provided in said primary bore defining an additional valve chamber having an inlet connected to the lower portion of said primary bore; an outlet connected to said fluid outlet bore and a valve seat between said inlet and outlet; and a check valve member cooperating with said valve seat to prevent reverse fluid flow from said outlet to said inlet.

3. A standing valve in accordance with claim 1 or 2 wherein means are provided within said primary bore defining an additional valve chamber having an inlet connected to the top portion of said fluid inlet bore; an outlet connected to the upper portion of said primary bore and a valve seat intermediate said inlet and outlet; and a check valve member cooperating with said valve seat to prevent reverse fluid flow from said outlet to said inlet.

4. A standing valve assembly in accordance with claim 1 or 2 wherein said means in said primary bore defining a plurality of axially stacked valve chambers comprises: an annular support element disposed in the upper portion of said primary bore and having a threaded lower end portion; a plurality of annular housing elements having their opposite ends threaded to permit the respective securement thereof in an axial stack threadably secured to the threaded lower end portion of said support element, each of said annular housing elements defining a valve chamber.

5. In an oil well pumping oil at a high volume rate from a well, the improvement comprising: a safety valve mounted in the lower portion of the well; a tubular housing insertable in the well above said safety valve; an axial projection on the lower end of said tubular housing insertable within said safety valve; a pump connected to the top end of said housing; said pump having an inlet at its lower end; said housing defining a vertically extending inlet passage communicable with the interior of said safety valve; and a separate, parallel, vertically extending outlet passage communicating with the inlet of said pump; means in said housing defining a plurality of axially spaced valve chambers each having a horizontally disposed inlet connecting with said inlet passage, a horizontally disposed outlet connecting with said outlet passage and an annular valve seat between said inlet and said outlet; and a valve member disposed in each said chamber cooperating therewith to prevent reverse flow from said outlet passage to said inlet passage, said inlet and outlet passages having a fluid flow area not greater than the total fluid flow area of all of said valve chambers.

6. In an oil well pumping apparatus for pumping oil at a high volume rate from a well, the improvement comprising: a tubular housing insertable in the well for transmitting well production fluids; a pump connected to the top end of said housing; said housing defining a vertically extending inlet passage communicable with the interior of said tubular housing; and a separate, parallel, vertically extending outlet passage communicating with the inlet of said pump; means in said housing defining a plurality of axially spaced valve chambers each having a horizontally disposed inlet connecting with said inlet passage, a horizontally disposed outlet connecting with said outlet passage and an annular valve seat between said inlet and said outlet; and a valve member disposed in each said chamber and cooperating therewith to prevent reverse flow from said outlet passage to said inlet passage, said inlet and outlet passages having a fluid flow area not greater than the total fluid flow area of all of said valve chambers.

7. A standing valve assembly for an oil well, comprising: a cylindrical housing insertable within the casing; a primary bore in said housing and extending vertically therethrough; means for connecting the top end of said primary bore to a pump inlet; an inlet bore extending vertically from the bottom portion of said housing partially up through said housing; an outlet bore extending vertically downwardly from the top portion of said housing partially through said housing; said three bores being disposed in triangular relationship in cross-section and with the top portion of said inlet bore lying adjacent to the lower portion of said outlet bore; means for connecting the lower end of said primary bore to a source of well fluid; means in said housing connecting the lower end of said inlet bore to said source of well fluid; conduit means in said housing for connecting the upper portion of said outlet bore with said primary bore; means in said primary bore defining a first axially extending valve chamber intermediate said lower end of said inlet bore and said outlet bore; said valve chamber having a horizontal inlet connecting with said inlet bore, a horizontal outlet connecting with said outlet bore and a valve seat between said inlet and said outlet; a check valve member cooperating with said valve seat to prevent reverse fluid flow from said outlet bore to said inlet bore; means in said primary bore defining a second valve chamber axially stacked beneath said first valve chamber and having an inlet connected to the lower portion of said primary bore, a horizontal outlet connected to said outlet bore and a valve seat between said inlet and outlet; and a check valve member cooperating with said last mentioned valve seat to prevent reverse fluid flow from said outlet to said inlet, said inlet bore and said outlet bore having a flow area not in excess of the total flow areas of the valve chambers.

8. A standing valve in accordance with claim 7 wherein means are provided within said primary bore defining a third axially stacked valve chamber having an inlet connected to the top portion of said fluid inlet bore; an outlet connected to the upper portion of said primary bore and a valve seat intermediate said inlet and outlet; and a check valve member cooperating with said valve seat to prevent reverse fluid flow said outlet to said inlet.

9. In an oil well pumping apparatus for pumping oil at a high volume rate from a well, the improvement comprising: a safety valve mounted in the lower portion of the well and having an upstanding nipple containing a depressable valve actuator; a tubular housing insertable in the well above said safety valve; a tubular projection on the lower end of said tubular housing insertable in the nipple of the safety valve to engage the actuator thereof, said housing having a primary bore extending vertically therethrough; means for connecting the top end of said housing to a pump inlet; an inlet bore extending vertically from the bottom portion of said housing partially up through said housing; an outlet bore extending vertically downwardly from the top portion of said housing partially through said housing; said three bores being disposed in triangular relationship in cross-section and with the top portion of said inlet bore lying adjacent to the lower portion of said outlet bore; means for connecting the lower end of said primary bore to a source of well fluid; means in said housing connecting the lower end of said inlet bore to said source of well fluid; conduit means in said housing for connecting the upper portion of said outlet bore with said primary bore; means in said primary bore defining a first axially extending valve chamber intermediate said lower end of said inlet bore and said outlet bore; said first valve chamber having a horizontal inlet connected to said inlet bore, a horizontal outlet connected to said outlet bore and a valve seat between said inlet and said outlet; a check valve member cooperating with said valve seat to prevent reverse fluid flow from said outlet bore to said inlet bore; means in said primary bore defining a second valve chamber axially stacked beneath said first valve chamber and having an inlet connected to the lower portion of said primary bore, a horizontal outlet connected to said outlet bore and a valve seat between said inlet and outlet; and a check valve member cooperating with said last mentioned valve seat to prevent reverse fluid flow from said outlet to said inlet, said inlet bore and said outlet bore having a flow area not in excess of the total flow areas of the valve chambers.

10. The improvement defined in claim 9 wherein means are provided within said primary bore defining a third axially stacked valve chamber having a horizontal inlet connected to the upper portion of said fluid inlet bore; an outlet connected to the upper portion of said primary bore and a valve seat intermediate said inlet and outlet; and a check valve member cooperating with said valve seat to prevent reverse fluid flow from said outlet to said inlet.

* * * * *